United States Patent [19]

Allen et al.

[11] 4,124,071

[45] Nov. 7, 1978

[54] HIGH VERTICAL AND HORIZONTAL CONFORMANCE VISCOUS OIL RECOVERY METHOD

[75] Inventors: Joseph C. Allen; Ralph J. Korstad, both of Bellaire, Tex.

[73] Assignee: Texaco Inc., New York, N.Y.

[21] Appl. No.: 810,145

[22] Filed: Jun. 27, 1977

[51] Int. Cl.[2] ..... E21B 43/24

[52] U.S. Cl. ..... 166/263; 166/245; 166/261; 166/272

[58] Field of Search ..... 166/245, 263, 261, 272, 166/256

[56] References Cited

U.S. PATENT DOCUMENTS

| | | | |
|---|---|---|---|
| 2,862,558 | 12/1958 | Dixon | 166/272 |
| 3,253,652 | 5/1966 | Connally, Jr. et al. | 166/245 |
| 3,358,754 | 12/1967 | Stelzer et al. | 166/245 |
| 3,976,137 | 8/1976 | Bousaid | 166/272 |
| 3,993,132 | 11/1976 | Cram et al. | 166/272 X |

*Primary Examiner*—Stephen J. Novosad
*Attorney, Agent, or Firm*—Carl G. Ries; Thomas H. Whaley; Jack H. Park

[57] ABSTRACT

Disclosed is an oil recovery method especially useful for recovering viscous oil from thick formations including tar sand deposits. The method comprises several phases which accomplish efficient recovery of the viscous oil from the formation with good vertical and horizontal sweep conformance or effectiveness. The first phase may utilize as few as two spaced apart wells, one for fluid injection and one for oil production and an oil recovery method such as injecting steam or a mixture of air and steam for low temperature, controlled oxidation is a preferred fluid for use in the first phase. After fluid breakthrough at the production well occurs, the producer of the first phase is converted to an injection well and one or more new production wells outside of the pattern swept by the injected fluid are completed in the oil formation. Thermal recovery fluids are then injected into two wells with the displacement moving in the direction of the new production wells. The oil displacement process of the second phase may be air or oxygen for high temperature in situ combustion. In thick formations, if the wells utilized in the first phase are completed low in the formation, the new production wells should be completed high in the formation to expand the recovery zone vertically to encompass more of the formation. A third phase employs a well located centrally to the four previous wells for production with air injection being into all four wells utilized in the first two cycles to further expand the three-dimensional extent of the swept zone within the pattern defined by the wells.

13 Claims, 6 Drawing Figures

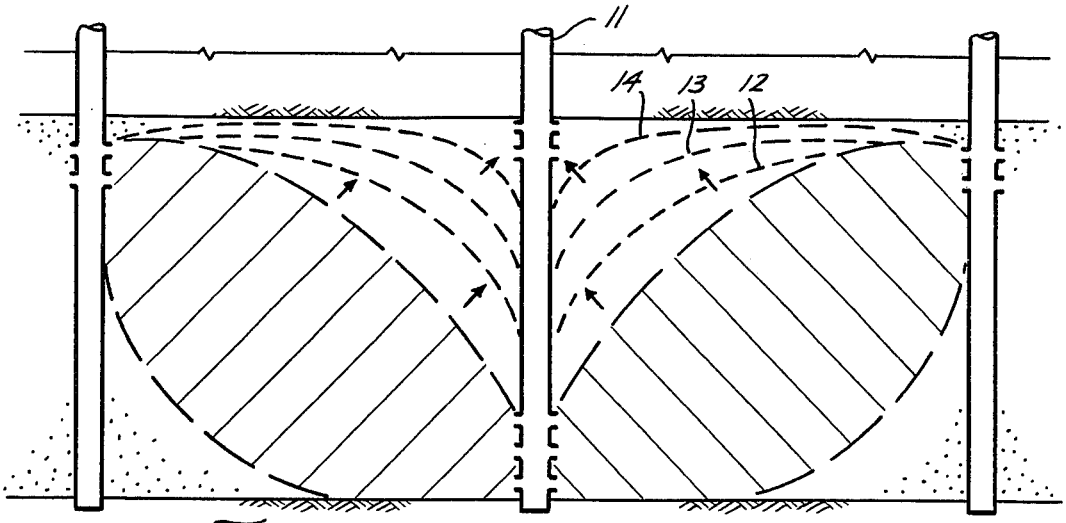
Fig. 5
Fig. 6
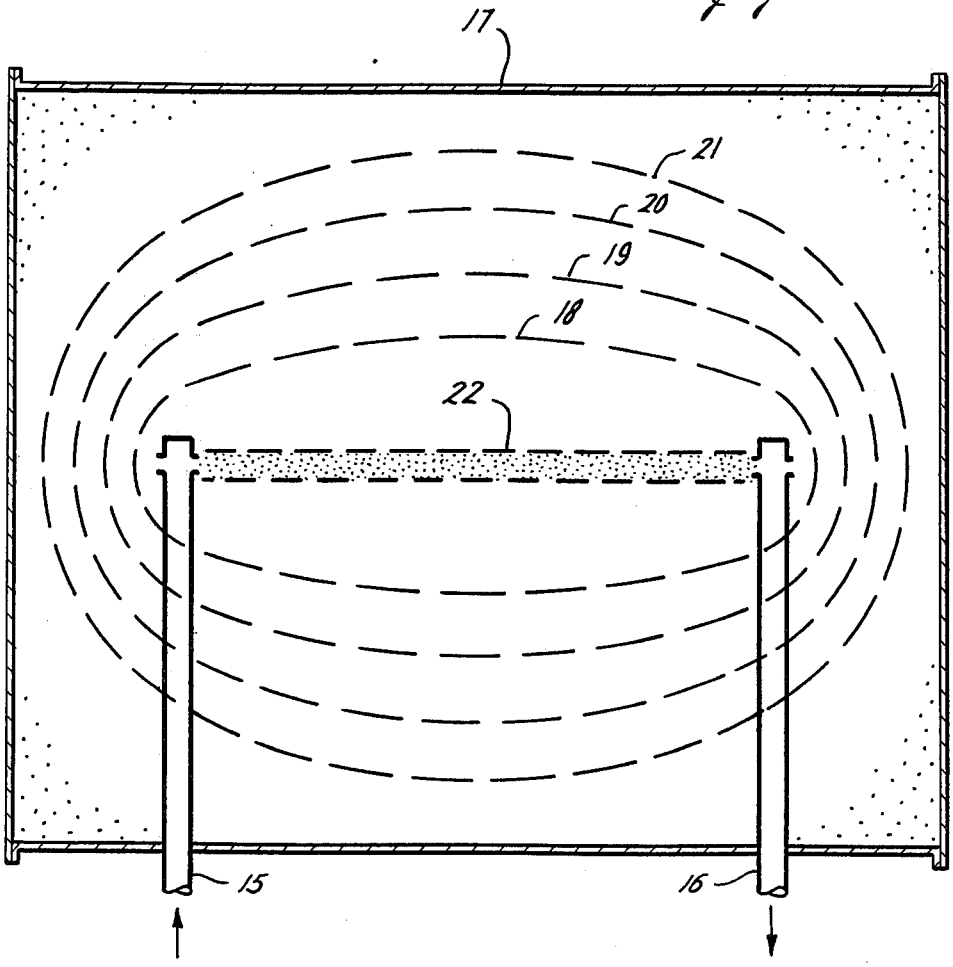

HIGH VERTICAL AND HORIZONTAL CONFORMANCE VISCOUS OIL RECOVERY METHOD

BACKGROUND OF THE INVENTION

1. Field of the Invention

This invention is concerned with an oil recovery method especially applicable to viscous oil formations, and more particularly is concerned with a multi-phase oil recovery method by means of which the portion of the formation depleted by application of the oil recovery method is expanded vertically and horizontally to achieve more efficient sweep of the formation within the pattern defined by the wells.

2. Background and Prior Art

There are many petroleum-containing formations known to exist throughout the world from which little or no petroleum can be recovered by primary or secondary means because the viscosity of the petroleum is so high that it is essentially immobile at reservoir conditions, and some process must be applied to the formation to decrease the viscosity or otherwise increase the mobility of the petroleum contained in the formation to permit recovery of any significant proportion thereof. The most extreme example are the so-called tar sand or bitumen sand deposits such as those found in the Western United States, Alberta, Canada, Venezuela, and lesser deposits in Europe and Asia. The viscosity of the bituminous petroleum in tar sand deposits ranges upward of several million centipoise at formation temperature, and so substantial viscosity reduction must be accomplished before recovery of petroleum therefrom is feasible.

Viscous oil recovery methods have traditionally involved thermal methods such as steam injection, or in situ combustion, or a method involving injection of a mixture of steam and air for a controlled, low temperature oxidation reaction. While these methods effectively deplete the portion of the formation swept by the fluids, the high viscosity of the formation petroleum and the low viscosity of the injected fluids usually results in the depleted portion of the formation between two or more wells utilized in the heavy oil recovery method representing a relatively small portion of the volume of the pattern defined by the wells utilized in the oil recovery method. Although poor sweep efficiency is a problem experienced in recovery of conventional oils as by water flooding or surfactant flooding, the problem is more severe in viscous oil formations because the sweep efficiency is adversely affected by a high ratio of petroleum viscosity to injected fluid viscosity. Oil recovery processes which in two-dimensional laboratory cells achieve high recovery efficiency, will be very much less successful in field application because the zone depleted by the process is confined to a small portion of the total volume of the formation in the pattern defined by the wells, and the failure to deplete the zone completely occurs in the vertical direction as well as in the horizontal direction.

In view of the foregoing discussion, it can be appreciated that there is a significant need for a method for expanding the zone depleted by viscous oil recovery processes in both the horizontal and vertical direction.

SUMMARY OF THE INVENTION

We have discovered a multi-phase recovery method applicable to viscous oil-containing formations, especially useful in relatively thick, viscous oil-containing formations including tar sand deposits, by means of which the volume depleted by the process may be expanded in both a vertical and horizontal direction over that achieved by conventional procedures. The first step may involve as few as two wells completed in the formation, one for oil production and one for thermal recovery fluid injection. Thermal fluid is injected and oil is produced until breakthrough of the thermal fluid at the production well and the ratio of injected fluid to petroleum in the fluid being produced from the production well begins rising rapidly. After completion of this first phase, the well or wells utilized in the first phase for oil production are converted to injection wells for use in the next phase, and one or more new production wells are completed in the formation outside the area depleted by the first phase, preferably being equidistant between the original injection well and original production well. A thermal recovery fluid is then injected into the new injection well as well as into the original injection well and production is taken from the new production well, with the result that the front between the injected fluid and the undepleted portion of the formation begins moving in a direction generally orthogonal to the direction it moved in the first phase, and the area depleted is expanded horizontally toward the new production well. In thick formations, if the injection well and production well of the first phase were completed near the bottom of the formation, the new production well is preferably completed in the top portion of the formation so the depleted portion is expanded vertically as well as horizontally. If the original injector and producer were completed in the top of the formation, then conversely the new producing well should be completed near the bottom of the formation. The second phase is continued until the injected fluid breaks through at the new production well and the ratio of injected fluid to produced formation petroleum rises to a value which is uneconomical.

In a preferred embodiment, a third phase is utilized in which a new production well is drilled near a central point relative to the wells employed in the preceding two phases and is completed at about the same depth as the production well of the second phase. Thermal fluid is then injected into all wells used in the first phase and into the well that served as a production well in the second phase, to expand the swept zone vertically toward the central production well in a generally upward direction, to sweep a substantially greater volume of the formation than is possible using prior art methods.

In a particularly preferred embodiment, a mixture of air and steam in an air/steam ratio from about 150 to about 650 standard cubic feet of air per barrel of steam (as water) is used in the first phase, to propagate a low temperature, controlled oxidation reaction between wells, thereby creating a high permeability depleted zone between the orignal wells. Air or oxygen-enriched air or heated oxygen is injected for a high temperature combustion reaction in the second and third phases of the process of our invention.

BRIEF DESCRIPTION OF THE DRAWINGS

FIG. 5 illustrates the horizontal expansion of the depleted zone in the third phase toward the new producing well which is completed in the upper portion of the formation.

FIG. 6 illustrates a simulator cell showing the extent of depletion around a communication path between an injection well and a production well.

DESCRIPTION OF THE PREFERRED EMBODIMENT

Figure 1:
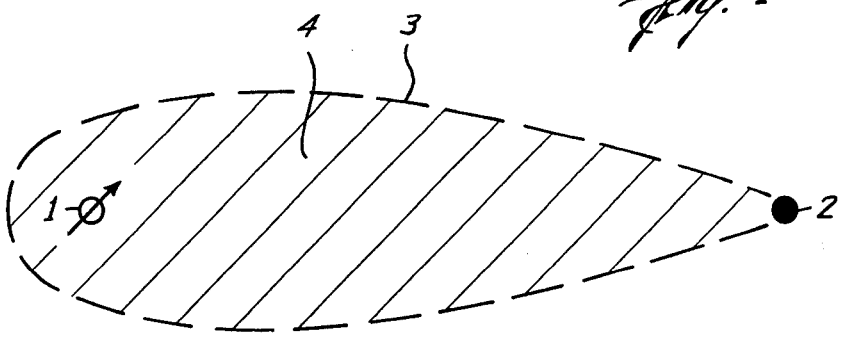
FIG. 1 illustrates the arrangement of a single injection well and a single production well and the horizontal swept zone resulting from the first phase of the process of our invention.

The detailed operating procedures to be employed in practicing the preferred embodiments of the process of our invention can best be understood by referring to the attached Figures in which FIG. 1 illustrates an areal view of a formation penetrated by two wells, wherein well 1 is completed as an injection well and well 2 is completed as a producing well. The horizontal extent of depletion of the formation by application of a process comprising injecting a thermal recovery fluid such as steam, air or a mixture of steam and air into well 1 and producing hydrocarbons from well 2 is illustrated by dashed line 3 and the area depleted is illustrated by crosshatched area 4. It can be seen that the area depleted is not entirely symmetrical, rather, it is an elongated depleted area is formed in the simple two well situation and ordinarily the ratio of the width of the depleted zone to the length as measured along a line through the two wells will be relatively low, e.g., substantially less than 1 and will be even lower in a viscous oil formation than in a conventional oil formation, because of the high oil viscosity. Although not shown in drawing, the vertical depletion is similarly restricted, and in thick oil formations the result is that only a small fraction of the vertical thickness of the formation is depleted as a consequence of the poor mobility ratio achieved in applying thermal recovery methods when the petroleum viscosity is extremely high, or when there is a large difference in densities of the injected fluid and formation petroleum.

Figure 2:
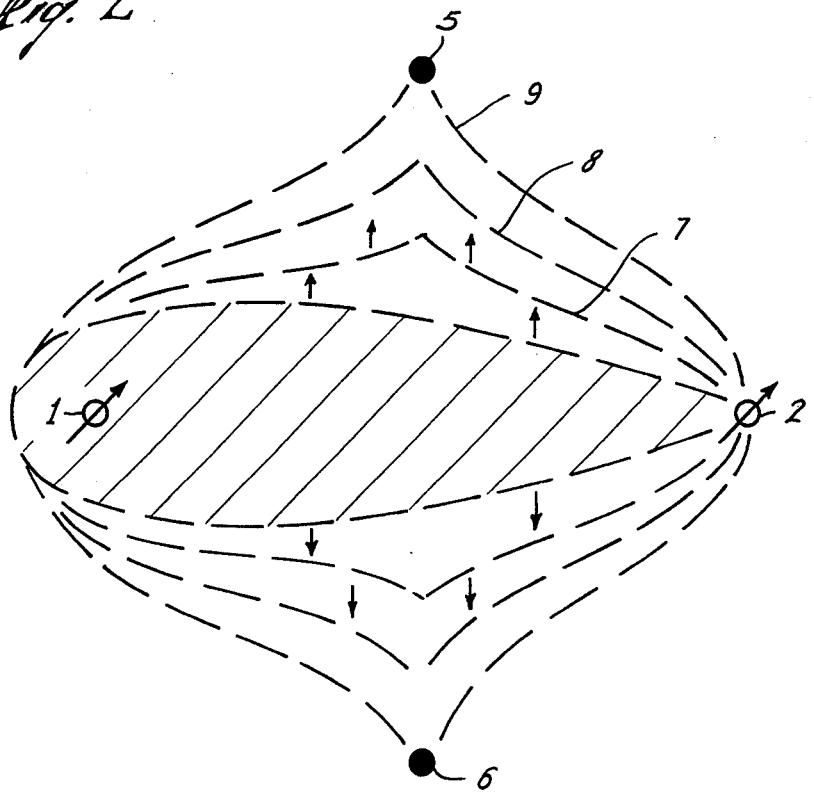
FIG. 2 illustrates the second phase of the process of our invention with the producing well from the first phase converted to an injector, and with two new producing wells being drilled, and shows the horizontal expansion of the depleted zone resulting from the the first phase toward the new producers to expand the depleted zone in the formation in a horizontal direction.

FIG. 2 illustrates the second phase of the process of our invention. Well 2, which was a producing well in phase one as is shown in FIG. 1 has been converted to an injection well in FIG. 2 for injecting thermal fluids into the formation. Well 1 continues in its role as an injection well in phase 2. Depleted zone 4 is a high permeability channel between the wells, so the pressure is relatively constant throughout depleted zone 4. Fluids injected into well 1 and well 2 of FIG. 2 behave somewhat as though a single well were employed, with relatively wide contact between the injection well and the undepleted portion of the formation. Production wells 5 and 6 should be located on opposite sides of the depleted zone, and if only one well is utilized on each side of the zone, they are preferably located approximately equidistant between original wells 1 and 2. Wells 5 and 6 may be located so they and original wells 1 and 2 define a square pattern, with the distances between wells being approximately equal, although this is not essential. If the permeability distribution is preferentially oriented in a particular direction, it may in fact be preferable to avoid exactly symmetrical distribution of the wells in order to accomplish more efficient depletion of the formation.

The front between the depleted zone and the undepleted zone of the formation, which in all of the drawings is illustrated by dashed lines, expands in a direction generally toward the production wells 5 and 6. Several dashed lines 7, 8, and 9 are drawn in FIG. 2 to illustrate the location of the interface between the depleted zone and the undepleted zone at different times and dashed line 9 represents the outline of the zone at about the time of breakthrough of injected fluid at production wells 5 and 6. Once fluid breakthrough at the production wells occur, continued injection of fluid into wells 1 and 2 will usually accomplish little additional oil production; since the injected fluid has much lower viscosity than the formation petroleum, and since the depleted zone ordinarily is much more permeable than the undepleted zone, the injected fluid will channel through the depleted zone rapidly to the production wells. Thus the endpoint of the second phase of the process of our invention is signalled by the arrival of injected fluid at the production wells 5 and 6. If produced fluid reaches one of the production wells sooner than the other, the production rate at that well may be reduced or the well may be shut in altogether to force the movement of the injected fluid toward the other production well. Once injected fluid is broken through at both of the production wells 5 and 6, the second phase of the process of our invention is concluded.

Figure 3:
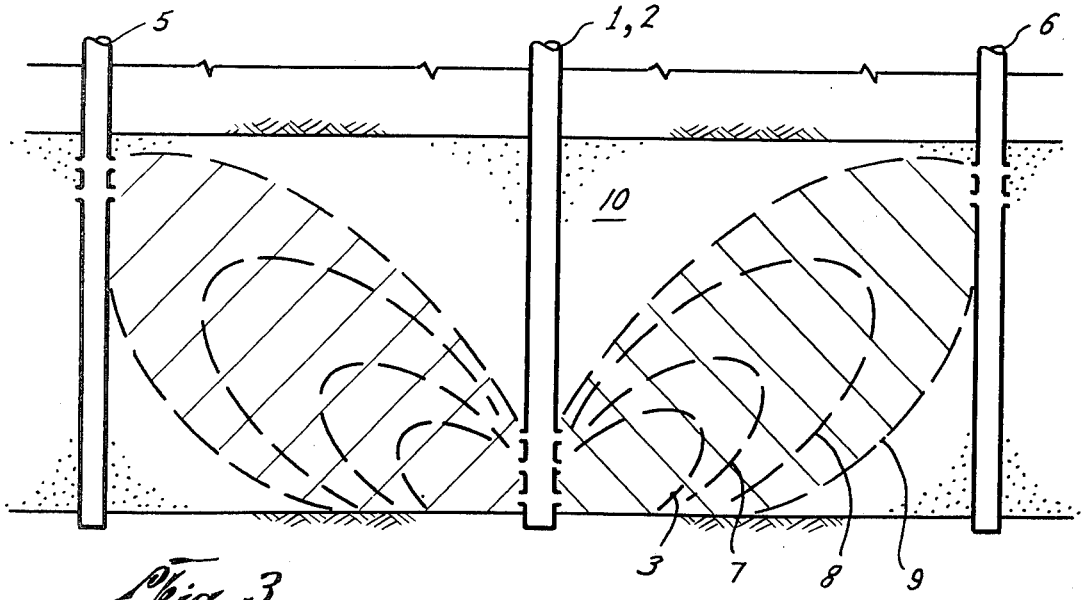
FIG. 3 illustrates the method whereby the new production wells of the second phase may be completed near the top of the formation in order to expand the depleted zone in a vertical direction.

Examination of the contour lines 3, 7, 8, and 9 of FIGS. 1 and 2 would suggest that the portions of the formation depleted by the process of our invention at the conclusion of the second phase is sufficiently high that no additional oil recovery is possible. This may in fact be true in shallow formations, but in relatively thick formations, the vertical conformance of the oil recovery process may be such that substantial additional petroleum remains above portions of the formation depleted by the first two phases. This is best understood by reference to FIG. 3, which illustrates in cross-sectional view a formation in which wells 1, 2, 3, and 4 have been completed as are shown in FIGS. 1 and 2, with wells 1 and 2 being completed near the bottom of the formation. If wells 5 and 6 were also completed near the bottom portion of the formation, the depleted zone 4 would be confined similarly to the lower portion of the formation. In FIG. 3, wells 5 and 6 have been completed near the top of the formation, which forces the depleted zone to be oriented upward in the formation and thus enlarges substantially the total cross-sectional area from which petroleum is recovered at the conclusion of the second phase of the process of our invention. This can be seen by the upward bending of dashed lines 7, 8, and 9 as they move away from the original depleted zone defined by dashed line 3, toward the completion points for production wells 5 and 6. While this method expands the depleted zone in a generally upward direction, it can be seen that a substantial area 10 exists between all four wells and generally in the upper portion of the formation from which essentially no production has been recovered.

Figure 4:
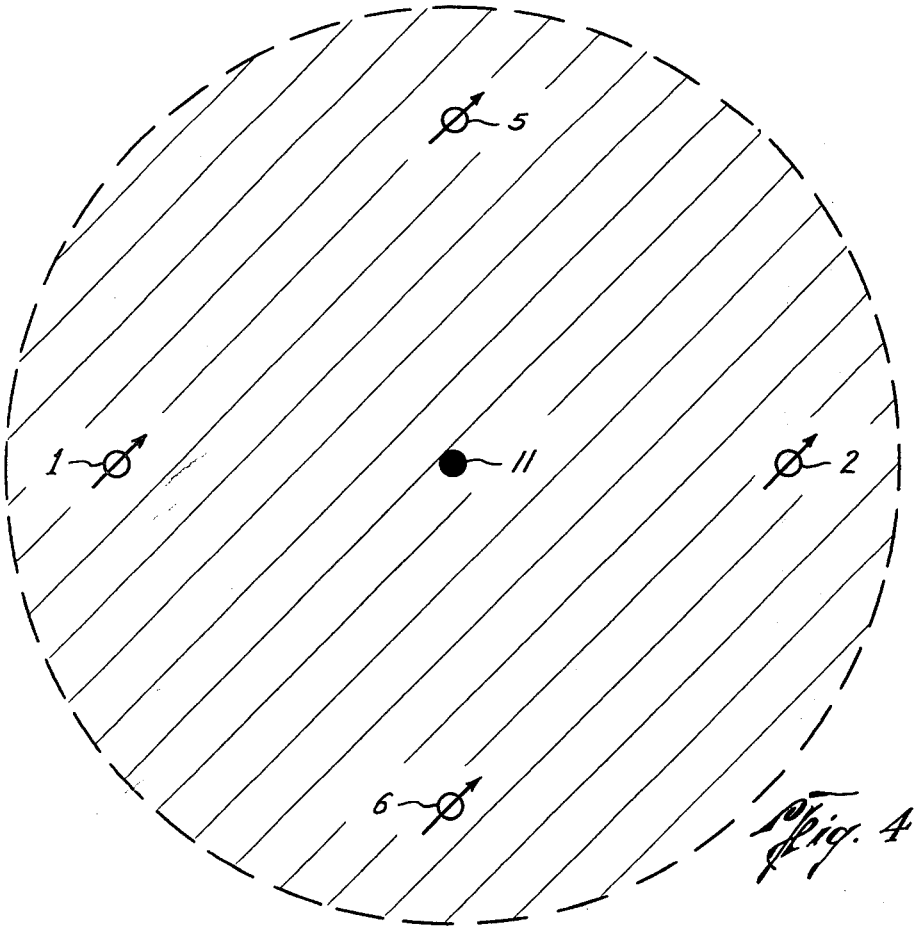
FIG. 4 illustrates the location of the new producing well for the third phase for the process of our invention central to the wells employed in the first two phases, with the producing wells of the second phase being converted to injection wells.

If it is desired to recover petroleum from portion 10 of the formation, a new production well 11 may be drilled into the pattern such as is illustrated in FIG. 4 by well 11, which should be located relatively centrally to the other wells employed in the first phases of the process of our invention. Wells 5 and 6, which were production wells for the second phase for the process of our invention, are converted to injection wells and wells 1 and 2 continue as injection wells for the third phase of the process of our invention. As is shown in cross-sectional view 5, well 11 is completed near the upper portion of the formation. Injection of fluids into wells 1, 2, 5, and 6 results in moving the interface between the depleted portion of the formation and undepleted portion of the formation in a direction toward the upper central portion of the pattern, from which petroleum may be recovered to the surface of the earth by means of well 11. In FIG. 5, dashed lines 12, 13, and 14 indicate the enlargement of the swept portion of the formation by application of a third phase of the process of our invention.

A particularly preferred method of employing the process of our invention will utilize a low temperature controlled oxidation reaction in the first phase, which is accomplished by injecting a mixture of air and steam into the formation via the injection well. The presence of steam moderates the reaction temperature of the combustion reaction, and is generally more effective for the first reaction applied to a formation which has very viscous petroleum and relatively low permeability. The reaction accomplishes significant depletion of the swept portion of the formation, but results in leaving a small amount of coke-like, essentially solid hydrocarbon material deposited on the formation matrix in the depleted zone. The low temperature controlled oxidation reaction is most effectively accomplished in viscous oil formations, particularly tar sand deposits, if the air to steam ratio is carefully controlled during the injection phase to a value between about 0.100 and about 1.0 M.F.C.F./bbl. (thousand standard cubic feet of air per barrel of steam, as water), and preferably from 0.150 to 0.650 M.S.C.F./bbl.

The second phase may advantageously employ a slightly different reaction, specifically a high temperature combustion reaction such as the more conventional forward in situ combustion reaction as has been described in the prior art. Thus when the production well from the first phase is converted to an injection well, steam injection is no longer required and air may be injected into the injection well at the maximum rate in order to propagate a high temperature combustion reaction toward the new production well described above. Not only does a combustion reaction occur at the interface between the depleted zone and the undepleted portion of the formation, but the coke residue remaining on the sand grains or mineral matrix of the formation within the zone depleted in the first phase of the process of our invention is also burned, generating heat and gaseous products of combustion which are beneficial to the recovery process being accomplished in the second phase of the process of our invention.

The above-described process may also be employed advantageously in other thermal recovery techniques. Steam injection may be applied in any or all of the stages described above, thereby achieving the improved volumetric sweep efficiency resulting from application of the process described therein. Also, a mixture of steam and from 2.0 to 20.0 percent by weight of a light hydrocarbon, e.g., a $C_3$–$C_{12}$ hydrocarbon including mixtures thereof. Commercially available hydrocarbons such as naphtha, kerosene or natural gasoline may also be used.

While the foregoing describes the preferred embodiment, it is not to be implied that these are the only methods utilizing the process of our invention whereby the depleted zone may be expanded vertically and horizontally within the pattern defined by the wells completed in the formation. For example, the second phase may be a continuation of the low temperature oxidation reaction accomplished by injecting a mixture of air and steam into wells 1 and 2 of the attached Figure, with the low temperature, controlled oxidation reaction continuing in the general direction of new production wells 5 and 6. Similarly, the general process described herein may be employed when a high temperature, conventional forward in situ combustion reaction is applied in both the first and second as well as in subsequent phases of the process of our invention. The same method may also be employed in other thermal fluid injection processes, such as for example steam injection or injection of a mixture of steam and light hydrocarbons which are well known in the art for viscous oil recovery applications.

When the preferred embodiment of the process of our invention is utilized, employing steam and air injection into the injection well or wells for accomplishing a low temperature controlled oxidation reaction in the first phase, followed by injection of air, oxygen enriched air, or substantially pure oxygen into the injection wells for accomplishing a forward, high temperature in situ combustion reaction in the second phase, the third phase should preferably employ the same thermal fluids as the second phase, i.e., air, oxygen enriched air or essentially pure oxygen for a high temperature, forward in situ combustion reaction for the third phase of the process of our invention.

EXPERIMENTAL SECTION

For the purpose of illustrating the operability of certain facets of the process of our invention, the following experimental work was performed. This is disclosed for purpose of additional illustration, however, and it is not intended to be limitative or restrictive of the process of our invention.

A run was made employing a three-dimensional simulator cell which is essentially a length of 18-inch steel pipe with one injection well and one production well located in the well. Neither well is immediately adjacent the cell wall, and the completion point of the wells is about midway in the length of the cell so the portion of the cell depleted by processes being studied may be examined, for the purpose of determining the vertical and horizontal depletion characteristics of displacement processes applied to tar sand deposits. Tar sand materials which were obtained by mining from a deposit in the Athabasca Tar Sand Deposits of Alberta, Canada were packed into the cell, compressed by tamping and then compressed by application of pressure by means of a hydraulically activated piston at the top of the cell provided for this purpose, to achieve a density equivalent to that encountered in natural deposits of tar sand materials. A sand path was provided between the point of injection and point of production to facilitate initial fluid injection through the cell, the sand path being formulated by forming a one-eighth inch thick layer of sand between the wells. Saturated steam and air were injected into the cell, the steam being approximately 100 percent quality. The air/steam ratio was about 0.2 thousand standard cubic feet of air per barrel of steam (as water), and the air saturated steam mixture was injected at 300 pounds per square inch at 400° F. The total recovery from the cell was only 47 percent and the total thermal efficiency was about 600,000 BTU's per barrel of oil produced, which is quite effective compared to conventional steam floods which frequently require about 1.2 million BTU's per barrel of produced oil. The depletion within the cell was very high along the communication path. FIG. 6 illustrates the general arrangement of cells including cell wall 17, injection well 15 and production well 16, with sand path 22 extending between the wells. Dotted contour line 18 represents the closest point to the sand path, and at the conclusion of the low temperature controlled oxidation reaction, the bitumen saturation along this line was about 2 percent by weight. Moving away from the zone closest to the sand path, the bitumen content along contour line 19 was about 6 percent; the bitumen content was about 10 percent near contour line 20 and about 14 percent near contour line 21. Thus it can be seen that while the process was extremely efficient at depleting the zone immediately adjacent to the communication path, the efficiency decreased rapidly with distance from that zone and essentially no bitumen was recovered from portions of the tar sand material packed into the cell located substantial distances from the contour line 21.

The residue was removed from the cell, blended, and packed into a high temperature in situ combustion cell and a conventional high temperature in situ combustion reaction was accomplished on this residue. An additional 44 percent of the oil originally present was recovered, bringing the total recovery to 91 percent. The thermal recovery efficiency of the second run was also very good, requiring only 600,000 BTU's per barrel of oil. Approximately 6 MCF of air was required per barrel of oil recovered. The temperatures observed in this laboratory test cell ranged upwards of 1,000° F. This clearly illustrates the successful application of high temperature in situ combustion recovery to the residue from a run in which a low temperature, controlled oxidation reaction had previously been applied.

While our invention has been described in terms of a number of illustrative embodiments, it is clearly not so limited since many variations thereof will be apparent to persons skilled in the art of enhanced oil recovery processes without departing from the true spirit and scope of our invention. While mechanisms have been discussed in the foregoing disclosure, they are offered only for purposes of initial disclosure, and we do not wish to be bound to any particular theory of explanation for the process of our invention. It is our desire and intention that our invention be limited and restricted only by those limitations and restrictions as appear in the claims appended immediately hereinafter below.

We claim:

1. A method for recovering viscous petroleum from a subterranean, viscous petroleum-containing formation comprising:

(a) penetrating the formation with at least two spaced apart wells, one of which is completed as an injection well and one of which is completed as a production well, both wells being completed near the bottom of the formation;

(b) injecting a first thermal oil recovery fluid into the injection well and recovering petroleum from the formation via the production well to form a first depleted zone in the formation, until breakthrough of the first thermal recovery fluid at the production well;

(c) thereafter converting the production well from the first phase to an injection well and penetrating the formation with at least one first additional production well completed near the top of the formation in a portion of the formation outside the first depleted zone;

(d) injecting a second thermal oil recovery fluid into the original injection well and the converted injection well and taking production of petroleum from the formation via the first additional production well until breakthrough of the second thermal recovery fluid at the production well;

(e) penetrating the formation with at least one second additional production well located between the original injection well and original production well of the first phase of step (b) and completed near the top of the formation;

(f) converting the first additional production well of (c) to an injection well; and (g) injecting a third thermal oil recovery fluid into all of the injection wells and producing petroleum from the second additional production well until breakthrough of the thermal oil recovery fluid at the second additional producing well.

2. A method as recited in claim 1 wherein the first thermal oil recovery fluid is a mixture of air and steam and the ratio of from about 0.150 to about 0.650 thousand standard cubic feet of air per barrel of steam (as water).

3. A method as recited in claim 1 wherein the second thermal oil recovery fluid is selected from the group consisting of air, oxygen enriched air, and substantially pure oxygen.

4. A method as recited in claim 1 wherein at least two new production wells are completed in step (c), the two wells being on opposite sides of the portion of the formation depleted by injecting the first thermal oil recovery fluid.

5. A method as recited in claim 4 wherein the two new production wells are located on a line which passes through the midpoint of a line between the original injection well and original production well.

6. A method as recited in claim 5 wherein the new production wells are located equidistant between the original injection well and original production well.

7. A method as recited in claim 1 wherein the third thermal oil recovery fluid is selected from the group consisting of air, oxygen-enriched air, and substantially pure oxygen.

8. A method as recited in claim 1 wherein the first thermal oil recovery fluid is steam.

9. A method as recited in claim 1 wherein the second thermal oil recovery fluid is steam.

10. A method as recited in claim 1 wherein the third thermal oil recovery fluid is steam.

11. A method as recited in claim 1 wherein the first thermal oil recovery fluid is a mixture of steam and from 2.0 to 20.0 percent of a $C_3$ to $C_{12}$ light hydrocarbon, kerosene, naphtha, natural gasoline and mixtures thereof.

12. A method as recited in claim 1 wherein the second thermal oil recovery fluid is a mixture of steam and from 2.0 to 20.0 percent of a $C_3$ to $C_{12}$ light hydrocarbon, kerosene, naphtha, natural gasoline and mixtures thereof.

13. A method as recited in claim 1 wherein the third thermal oil recovery fluid is a mixture of steam and from 2.0 to 20.0 percent of $C_3$ to $C_{12}$ light hydrocarbon, kerosene, naphtha, natural gasoline and mixtures thereof.

* * * * *